United States Patent [19]

Held

[11] 4,122,775

[45] Oct. 31, 1978

[54] LAND MINE OF THE HOLLOW-CHARGE TYPE

[75] Inventor: Manfred Held, Aresing, Germany

[73] Assignee: Messerschmitt-Bölkow-Blöhm GmbH, Munich, Germany

[21] Appl. No.: 802,420

[22] Filed: Jun. 1, 1977

[30] Foreign Application Priority Data

Jun. 3, 1976 [DE] Fed. Rep. of Germany ..... 2624927

[51] Int. Cl.[2] ..... F42B 23/24

[52] U.S. Cl. ..... 102/8

[58] Field of Search ..... 102/8

[56] References Cited

U.S. PATENT DOCUMENTS

| | | | |
|---|---|---|---|
| 3,956,988 | 5/1976 | Pecksen | 102/8 |
| 4,040,354 | 8/1977 | Stern | 102/8 |
| 4,058,060 | 11/1977 | Dukic | 102/8 |

FOREIGN PATENT DOCUMENTS

| | | | |
|---|---|---|---|
| 2,423,912 | 11/1975 | Fed. Rep. of Germany | 102/8 |

*Primary Examiner*—Charles T. Jordan
*Attorney, Agent, or Firm*—McGlew & Tuttle

[57] ABSTRACT

The land mine, comprises a flat mine housing having top and bottom flat broad surfaces and a side edge which is at least partly cylindrical. A tubular bushing extends in the housing between the top and bottom and it is closed on one of the surfaces by a cover. A firing system is located in the bushing for igniting an explosive charge which is contained in the remaining portion of the housing. Either or both of the top and bottom surfaces contain one or more projectile-forming hollow charge covers which engage directly over the explosive charge located within the housing. The mine may be formed with a half-cylindrical surface and a flat edge having a notch for engagement over a central mounting rod, or the mine may be made as a complete cylinder or disc. The hollow-charge liners are advantageously made circular and are arranged at one or more equally spaced locations around the surface of the top and bottom of the mine housing.

8 Claims, 9 Drawing Figures

LAND MINE OF THE HOLLOW-CHARGE TYPE

FIELD AND BACKGROUND OF THE INVENTION

This invention relates in general to the construction of mines and, in particular, to a new and useful land mine of the hollow-charge type having a housing with one or more hollow-charge, projectile-forming liners on either top or bottom broad surfaces thereof.

DESCRIPTION OF THE PRIOR ART

A land mine for fighting armored wheeled and/or tracklaying vehicles is known from German Offenlegunsschrift No. 2,207,840 which, due to its relatively small size, does not require burying in or camouflaging on the ground and which, in addition, because of its relatively small weight, can not only be carried along by soldiers in action against armored targets, but also can be laid in large numbers from airplanes, fighting helicopters or rocket warheads. Such a mine comprises a rotationally symmetrical hollow body in the form of a tube in the interior of which a hollow, completely closed ball of a size not exceeding the length of the tube is secured. Another hollow ball is mounted therein for rolling motion in a definite, radially spaced relationship. This second ball includes a circularly cylindrical bursting charge which is provided on one of its front faces with a sharp-point-forming flat charge covering piece. Through mechanical means associated with the charge and with the inner ball and in cooperation with the outer ball, the bursting charge is capable, independently of the spatial position of the tube, of automatically moving into a position in which its sharp-point-forming flat charge covering piece points upwardly. A disadvantage of this design is that the bursting charge is prevented from such a directional motion, which is important for an effective action, if the inner and/or outer hollow ball is deformed by the impact following a mine drop from the air.

SUMMARY OF THE INVENTION

The present invention is directed to a land mine of the kind mentioned above in which any expensive design sensitive to disturbances as described above is avoided, and which, among other advantages, includes the advantages that it is excellently suitable for being laid in large numbers from the air and ensures a high destructive effect on targets of unequal nature at any time, such as belts and shells of armored vehicles.

In accordance with the invention, the bursting charge received therein is provided with at least one covering plate acting as a projectile on each of the two broad sides of a mine case of flat shape. The inventive design is inespensive, and the manufacture of the mine is simple.

The land mine of the invention can be spread from the air and, in such a laying operation, due to the flat shape of the case, after impinging on the ground and perhaps some subsequent sliding motion, the mine comes to a stop even on a sloping ground, in a position in which clearly defined surface portions thereof, namely, those of one of the broad sides, are in contact with the ground. Considering this, and the provided disposition of the covering plates, upon terminating the aerial laying operation in which, in view of the relatively small thickness of the mines as indicated, by way of example, in the embodiments shown, a large number of mines can be easily dropped from airplanes, helicopters or rocket warheads. At least one of the projectile-forming covering plates of each mine remains ready for effective action in a direction away from the ground. Thereby, and by the fact that contrary to the hitherto prevailing opinion of experts in this field, quite satisfactory, powerful projectiles, formed by the explosion, are obtained from the covering plates, even with a relatively small dimension of the bursting charge in the direction of the longitudinal axis of the covering plate, and with a striking detonation wave. The superiority of the inventive mine over the prior art of similar kind is due, inter alia, to the requirements of permitting an aerial mine-laying in large numbers, of rendering a location of the mines openly laid in this manner more difficult, of a versatile use, and of ensuring, in any instance, an effective action against potential targets, such as endless tracks and bottom shells of armored vehicles.

The projectile effect which can be obtained with the inventive mines is unexpectedly good. This is due, inter alia, to the relative short duration of the pressure impulse upon firing, resulting from the small dimensions of the charge in the direction of action of the covering plate, which is capable of turning the covering plate or plates inside out, without fragmentizing them into a great number of splinters. The firing system for detonating the charge preferably comprises, in a manner known per se, sensors, for example, a magnetic field sensor in combination with a vibration sensor, a time sensor, and an impact lock, with the corresponding power supply and ignition electronics, and with well-known safety devices. For simplification of the construction, it is advisable to leave a space between the projectile-forming covering plates on both broad sides of the case for a fuse hole bushing extending transversely thereto, and to accommodate the firing system in the bushing.

In rocket warheads and transport containers of airplanes or helicopters, particularly high filling ratios can be obtained with embodiments where the mine case, designed in accordance with the invention, has the shape of a semi-circular part of a disc or an entire circular disc. In both instances, it appears useful, not the least because of the small height of the case, to provide the projectile-forming covering plate or plates on ones of the broad sides of the casing having a position which is offset in the circumferential direction of the disc or disc part relative to the projectile-forming covering plate or plates on the other broad side of the case.

If the mine case has the shape of a semi-circular part of a disc, it is advisable to provide a notch-shaped recess in the central portion of the flat narrow side of the case extending from one broad side of the case to the other broad side for receiving a central mounting rod which, if the arrangement is intended for a rocket warhead, may, at the same time, be designed as a gas generator which is capable of imparting an ejection impulse to the mines placed therearound, at a desired point of time.

If the mine has the shape of a complete circular disc, the central area is available for providing a fuse hole bushing therein, having the purpose mentioned above. However, such a fuse hole bushing may also be disposed eccentrically, which does not adversely affect the efficiency of the projectiles formed upon detonation.

Accordingly, it is an object of the invention to provide an improved land mine of the hollow-charge type, which comprises a flat mine housing with a bursting charge in a firing system in the housing and, wherein, the housing has a broad side on each side with at least one projectile-forming covering plate overlying the bursting charge.

Another object of the invention is to provide such a land mine having a flat housing with at least a partially cylindrical side wall and broad walls on each side, which include one or more cylindrical projectile-forming covers and which also includes a casing in the housing which extends between the top and bottom walls and define a place for the firing system.

A further object of the invention is to provide a land mine of the hollow-charge type, which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawings and descriptive matter in which there are illustrated preferred embodiments of the invention.

DESCRIPTION OF THE PREFERRED EMBODIMENTS

Figure 1:
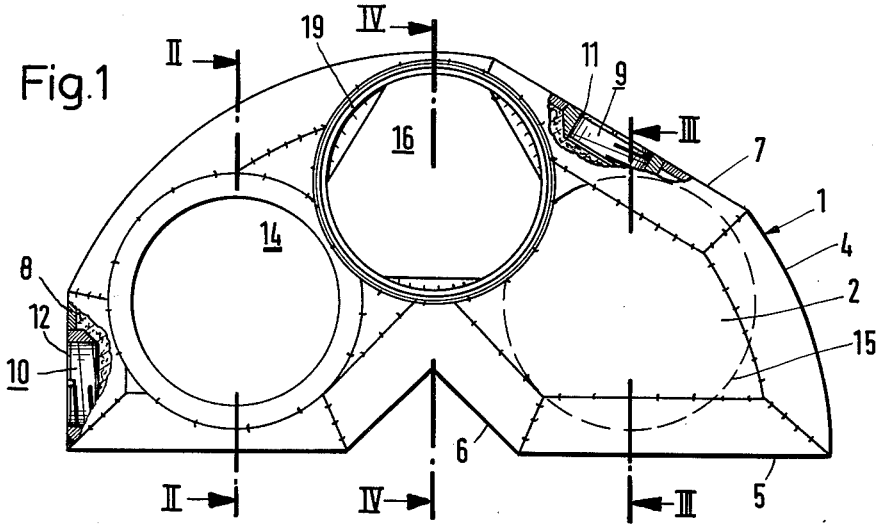
FIG. 1 is a top plan view, partly in section, of a land mine constructed in accordance with the invention, and showing one of the broad sides thereof.
Figure 2:
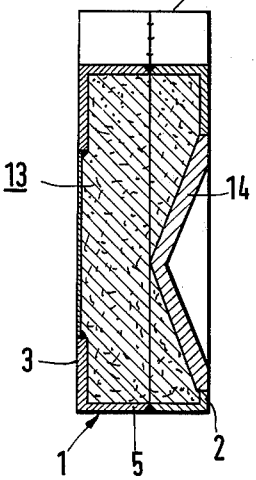
FIG. 2 is a sectional view taken along the line II—II of FIG. 1.
Figure 3:
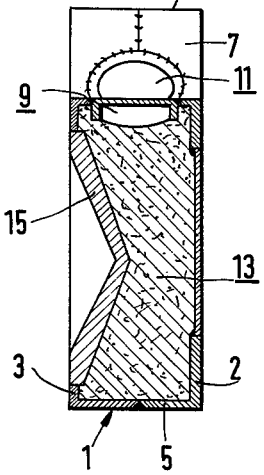
FIG. 3 is a similar view taken along the line III—III of FIG. 1.
Figure 4:
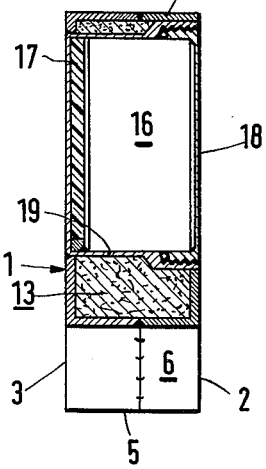
FIG. 4 is a similar view taken along the line IV—IV of FIG. 1.

Referring to the drawings in particular, the invention embodied therein, comprises a land mine which includes a flat mine housing or casing 1, which is advantageously formed of at least partially cylindrical end or side walls as in the case of the embodiment shown in FIGS. 1 to 4, or as a complete cylindrical flat disc as in the other embodiments of the invention.

In the land mine according to FIGS. 1 to 4, there is a welded case or housing 1, in the form of a semi-circular part of a disc. The peripheral surfaces of case 1 include broad sides 2 and 3, the circular narrow side 4, and the flat narrow side 5. A recess in the shape of a notch 6 is provided in the middle portion of flat narrow side 5 extending from broad side 2 of case 1 to broad side 3. If a plurality of mines of the kind described is placed in a rocket warhead, notches 6 provide space for a central mounting rod (not shown). The mounting rod may be designed as a gas generator having the purpose of imparting an ejection impulse to the mines placed thereabout, as soon as the shell of the warhead is destroyed.

Circular narrow side 4 of the casing is provided with flats 7 and 8 and with bores 9 and 10 leading to the interior of the casing. The bores comprise tapholes which are associated with closures in the form of screw covers 11 and 12. The bores serve to fill casing 1 with pourable explosive mixtures 13. With respect to flats 7 and 8, the following is to be noted in addition: In rotationally symmetrical warheads in which, due to their cross-section, two mines of the embodiment in discussion can always be accommodated in a single cross-sectional plane, the flats provide free space for cutting cords which may be used for ripping up the warhead shell, or for ignition cables.

On each of broad sides 2 and 3 of casing 1, for example, one projectile-forming covering plate 14 or 15 is provided, adjacent poured-in bursting charge 13. A firing system 16 is placed, along with a transfer charge 17, in a fuse hole bushing 19, which is closable by means of a cover 18. Fuse hole bushing 19 is located in an area between the two projectile-forming covering plates 14, 15 from broad side 2 of casing 1 to broad side 3.

Figure 5:
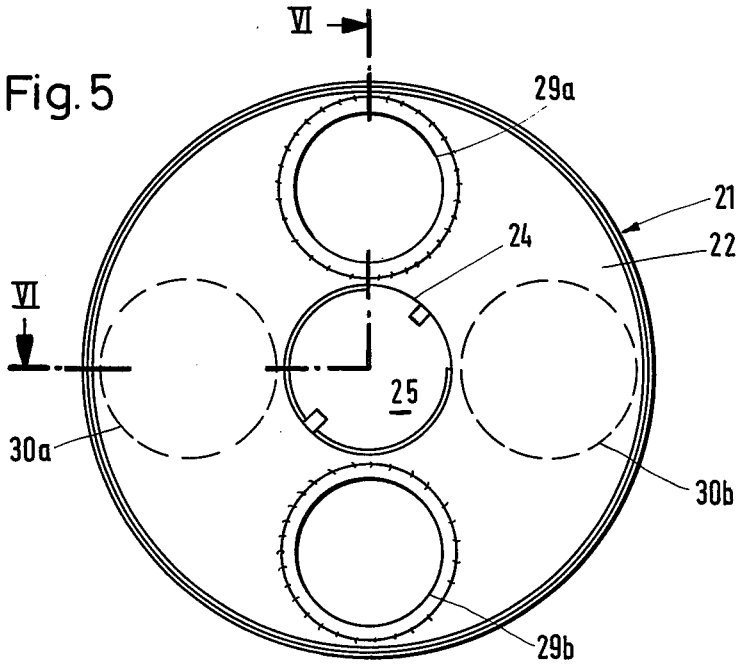
FIG. 5 is a view corresponding to FIG. 1 of another embodiment of the mine constructed in accordance with the invention.
Figure 6:
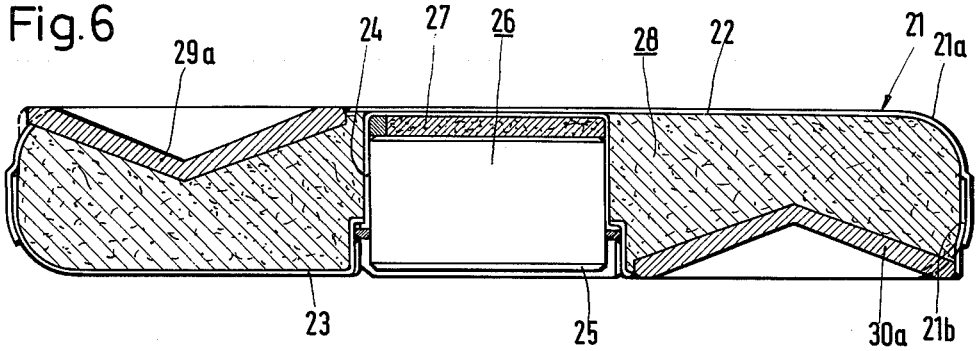
FIG. 6 is a sectional view taken along the line VI—VI of FIG. 5.

In the embodiment shown in FIGS. 5 and 6, the land mine comprises a casing 21, in the shape of a full circular disc, which is assembled of two upper and lower parts **21*a* and 21*b*. The two broad sides of the casing 21 are designated 22 and 23. In the center of the disc-shaped casing 21, there is a fuse hole bushing 24 which extends from one of the broad sides 22 of the casing to the other broad side 23. A firing system 26 and a transfer charge 27 are accommodated in a fuse hole bushing 24, between its bottom and cover 25. The bushing is surrounded by a bursting charge 28. Adjacent bursting charge 28, on either or both of broad sides 22 and 23 of the casing, two projectile-forming covering plates 29*a* and 29*b* and 30*a*, and 30*b* are provided which are angularly spaced from each other through 180°. In the embodiment shown, plates 29*a*, 29*b* and plates 30*a*, 30*b* on the respective broad sides 22 and 23 are located in staggered position relative to each other. In the present example, bursting charge 28 has been pressed in place, by means of a molding press, prior to assembling case part 21*a* with case part 21*b*. In the same operation, the recesses in the charge for covering plates 29*a*, 29*b*, 30*a* and 30*b*, as well as the rounds for the rim of case part 21*a***, are formed.

Figure 7:
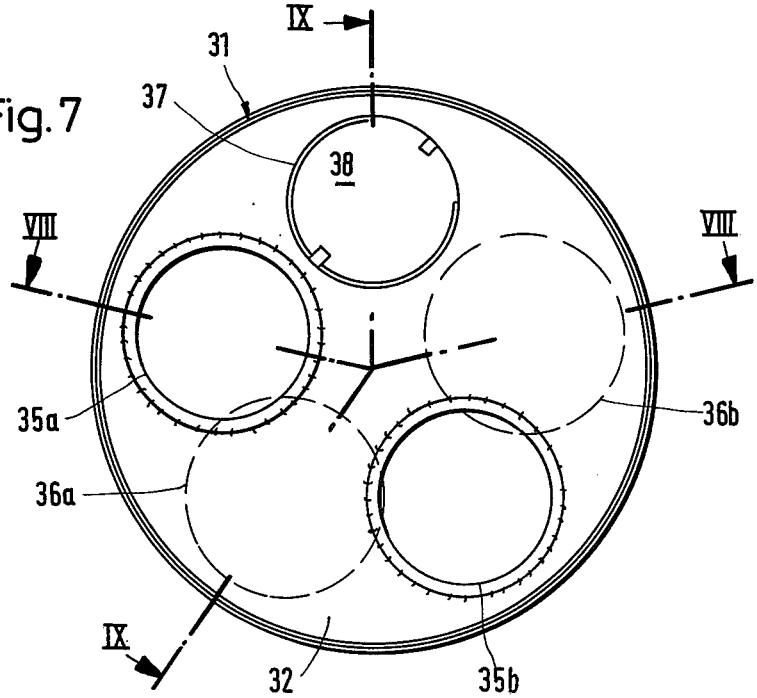
FIG. 7 is a view corresponding to FIG. 1 of still another embodiment of the mine constructed in accordance with the invention.
Figure 8:
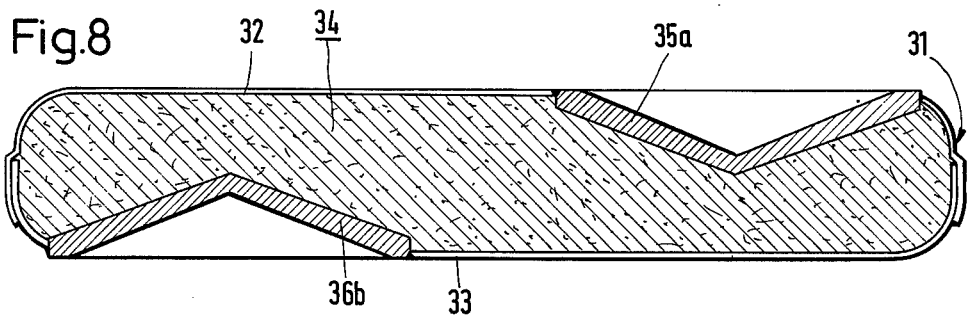
FIG. 8 is a sectional view taken along the line VIII—VIII of FIG. 7.
Figure 9:
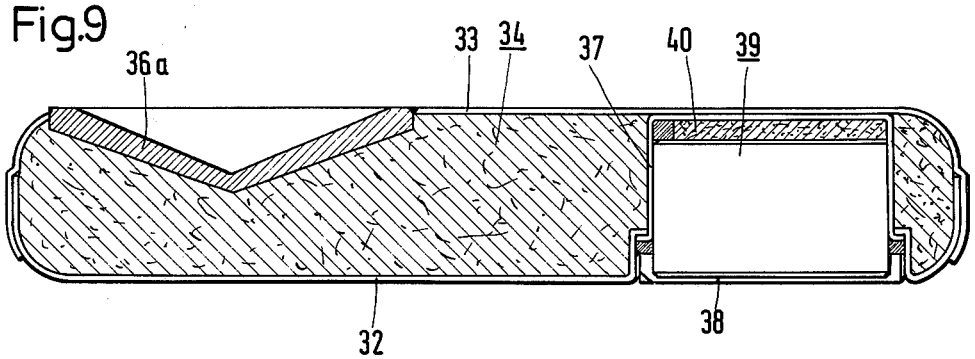
FIG. 9 is a sectional view taken along the line IX—IX of FIG. 7.

In the embodiment of FIGS. 7 to 9, the land mine again comprises a two-part casing 31 in the shape of a disc. The design is also similar in that, adjacent the bursting charge 34, for example, two projectile-forming covering plates **35*a*, 35*b* and 36*a*, 36*b* are provided on each of the broad sides 32, 33 of casing 31. In addition, a fuse hole bushing 37 with a cover 38 for receiving a firing system 39 associated with the bursting charge 34 and also a transfer charge 40 are provided. As distinguished from the embodiment according to FIGS. 5 and 6, however, fuse hole bushing 37 is disposed eccentrically in mine casing 31. In this arrangement, the radial distance of the longitudinal axis of bushing 37 from the disc center is equal to the radial spacing from this center of the longitudinal axes of the individual projectile-forming covering plates 35*a*, 35*b*, 36*a* and 36*b*. Also equal to each other are the angular spacings of the fuse hole bushing 37, covering plate 35*a*, covering plate 36*a*, covering plate 35*b* and covering plate 36*b***, in the order indicated in the circumferential direction of the disc.

While specific embodiments of the invention have been shown and described in detail to illustrate the application of the principles of the invention, it will be understood that the invention may be embodied otherwise without departing from such principles.

What is claimed is:

1. A land mine, of the hollow-charge type, comprising a flat mine housing having top and bottom flat broad surfaces and a side edge which is at least partially cylindrical, a tubular bushing in said housing extending between said top and bottom, a firing system in said tubular bushing, a bushing cover enclosing said bushing, an explosive charge in said housing between said flat board surfaces, and at least one projectile-forming cover engaged over the explosive charge on the top and bottom of said housing and forming a part of said broad surface, the projectile-forming covers on respective opposite broad sides being offset from each other.

2. A land mine, according to claim 1, wherein said broad surfaces are semi-circular, the edge of said housing being curved around one side and having a flat end side with a notch defined therein extending between said top and bottom surfaces.

3. A land mine, according to claim 1, wherein said mine has the shape of a circular disc and wherein there are a plurality of projectile-forming covers forming part of said top and bottom broad surfaces on each top and bottom surface, the covers on the top surface being offset from the covers on the bottom surface.

4. A land mine, according to claim 1, wherein said tubular bushing with said firing system is concentrically arranged in said housing, said housing comprising a flat cylindrical disc.

5. A land mine, according to claim 1, wherein said tubular bushing is eccentrically arranged, said housing comprising a flat cylindrical disc.

6. A land mine, according to claim 1, wherein said housing comprises a half-cylindrical disc having a curved cylindrical edge with at least one flat thereon having a threaded bore to the interior of the housing with a screw cover over said bore.

7. A land mine, according to claim 6, wherein said projectile-forming cover includes a cylindrical hollow charge liner located to one side of said bushing on the top of said housing and located on the opposite side of said bushing on the bottom of said housing.

8. A land mine, according to claim 1, wherein said mine housing comprises a flat, substantially cylindrical disc, each top and bottom surface having a plurality of cylindrical liners overlying an explosive charge comprising a projectile-forming cover disposed at angularly spaced locations around the top and bottom surfaces.

* * * * *